US009415615B2

(12) United States Patent
Momose

(10) Patent No.: US 9,415,615 B2
(45) Date of Patent: Aug. 16, 2016

(54) PRINTING APPARATUS AND COCKLE REMOVING METHOD

(71) Applicant: SEIKO EPSON CORPORATION, Tokyo (JP)

(72) Inventor: Seigo Momose, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/664,280

(22) Filed: Mar. 20, 2015

(65) Prior Publication Data

US 2015/0273881 A1 Oct. 1, 2015

(30) Foreign Application Priority Data

Mar. 27, 2014 (JP) ..... 2014-065413

(51) Int. Cl.

| | |
|---|---|
| ***B41J 3/407*** | (2006.01) |
| ***B41J 11/00*** | (2006.01) |
| ***B41J 15/16*** | (2006.01) |
| ***B65H 23/02*** | (2006.01) |

(52) U.S. Cl.

CPC ..... *B41J 15/16* (2013.01); *B41J 3/4078* (2013.01); *B41J 11/0005* (2013.01); *B41J 11/005* (2013.01); *B41J 11/0015* (2013.01); *B65H 23/02* (2013.01)

(58) Field of Classification Search

CPC ..... B41J 2/01; B41J 3/4076; B41J 11/0005; B41J 15/165; B65H 23/022

See application file for complete search history.

(56) References Cited

U.S. PATENT DOCUMENTS

| | | | | |
|---|---|---|---|---|
| 8,814,953 | B1 * | 8/2014 | Abbott et al. | 8/499 |
| 2006/0033796 | A1 * | 2/2006 | Samii et al. | 347/106 |
| 2013/0076814 | A1 | 3/2013 | Kanaya et al. | |

FOREIGN PATENT DOCUMENTS

| | | | |
|---|---|---|---|
| EP | 0718228 | A2 | 6/1996 |
| JP | 2002-249976 | A | 9/2002 |
| JP | 2011208306 | A * | 10/2011 |

OTHER PUBLICATIONS

The Extended European Search Report for the corresponding European Application No. 15161005.2 dated Jul. 14, 2015.

* cited by examiner

*Primary Examiner* — Kristal Feggins
*Assistant Examiner* — Kendrick Liu
(74) *Attorney, Agent, or Firm* — Global IP Counselors, LLP

(57) ABSTRACT

A printing apparatus includes: a transport unit that has a fixing unit which holds a part of an elongated recording medium and that transports the recording medium to each fixing unit; a recording unit that discharges ink onto the recording medium and performs recording; and a cockle removing mechanism that removes a cockle on the recording medium when the recording medium is sent toward the fixing unit side. The cockle removing mechanism has a first holding unit that holds one end portion of the recording medium in a lateral direction and a second holding unit that holds the other end portion of the recording medium in the lateral direction. The first holding unit and the second holding unit are configured to apply stress to the recording medium in a separating direction from each other.

8 Claims, 3 Drawing Sheets

PRINTING APPARATUS AND COCKLE REMOVING METHOD

BACKGROUND

1. Technical Field

The present invention relates to a printing apparatus and a cockle removing method.

2. Related Art

A printing apparatus is known, in which a recording medium such as a fabric wound in a roll shape is unwound and transported and a recording head performs printing (textile-printing) on the transported recording medium.

In such a printing apparatus, a problem arises in that, when there is a cockle on a recording medium during printing, the quality of printing deteriorates.

In order to solve such a problem, a printing apparatus that includes a cockle stretching mechanism which is configured to have V-shaped (disconnected at the vertex) ribs is disclosed (for example, see JP-A-2002-249976).

However, in the printing apparatus in the related art, it is not possible to achieve a sufficient cockle removal effect. Particularly, in the printing apparatus in the related art, a cockle stretching effects is changed due to a type of recording medium or a transport state of a recording medium and thus, it is difficult to take measures with respect to various types of recording media.

SUMMARY

An advantage of some aspects of the invention is to provide a printing apparatus and a cockle removing method in which it is possible to easily remove a cockle on a recording medium.

The advantage is achieved by the following aspects of the invention.

Application Example 1

According to this application example, there is provided a printing apparatus including: a transport unit that has a fixing unit which holds a part of an elongated recording medium and that transports the recording medium to each fixing unit; a recording unit that discharges ink onto the recording medium and performs recording; and a cockle removing mechanism that removes a cockle on the recording medium when the recording medium is sent toward the fixing unit side. The cockle removing mechanism has a first holding unit that holds one end portion of the recording medium in a lateral direction and a second holding unit that holds the other end portion of the recording medium in the lateral direction. The first holding unit and the second holding unit are configured to apply stress to the recording medium in a separating direction from each other.

In this case, it is possible to easily remove a cockle on the recording medium.

Application Example 2

In the printing apparatus according to the application example, it is preferable that the first holding unit and the second holding unit have a needle shape.

In this case, it is possible to more reliably hold the end portion of the recording medium in the lateral direction and thus, it is possible to more easily remove a cockle on the recording medium.

Application Example 3

In the printing apparatus according to the application example, it is preferable that the first holding unit and the second holding unit have a nipping mechanism; the first holding unit is configured to nip one end portion of the recording medium in the lateral direction and the second holding unit is configured to nip the other end portion of the recording medium in the lateral direction.

In this case, it is possible to more reliably hold the end portion of the recording medium in the lateral direction and thus, it is possible to more easily remove a cockle on the recording medium.

Application Example 4

In the printing apparatus according to the application example, it is preferable that the cockle removing mechanism includes a arcuate member, and the first holding unit and the second holding unit are provided on both end sides of the arcuate member, respectively.

In this case, it is possible to more easily remove a cockle on the recording medium.

Application Example 5

In the printing apparatus according to the application example, it is preferable that a distance adjusting unit that adjusts a distance between the first holding unit and the second holding unit is further included.

In this case, it is possible to more efficiently apply the stress toward the outer sides of the recording medium in a lateral direction and thus, it is possible to more easily remove a cockle on the recording medium.

Application Example 6

In the printing apparatus according to the application example, it is preferable that the stress applied to the recording medium is changed depending on a type of recording medium.

In this case, it is possible to more easily remove a cockle on various types of recording media.

Application Example 7

In the printing apparatus according to the application example, it is preferable that the fixing unit has an endless belt which has an adhesive surface on a side facing the recording medium.

In this case, it is possible to stably transport the recording medium by a simple configuration.

Application Example 8

According to this application example, there is provided a cockle removing method of removing a cockle on an elongated recording medium on which ink is applied and recording is performed during transporting of the recording medium, the method including: applying stress to the outer sides of the recording medium in a lateral direction, with respect to the recording medium.

In this case, it is possible to easily remove a cockle on the recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus and a cockle removing method of the invention will be described in detail based on an exemplary embodiment illustrated in the reference drawings.

Printing Apparatus

Figure 1:
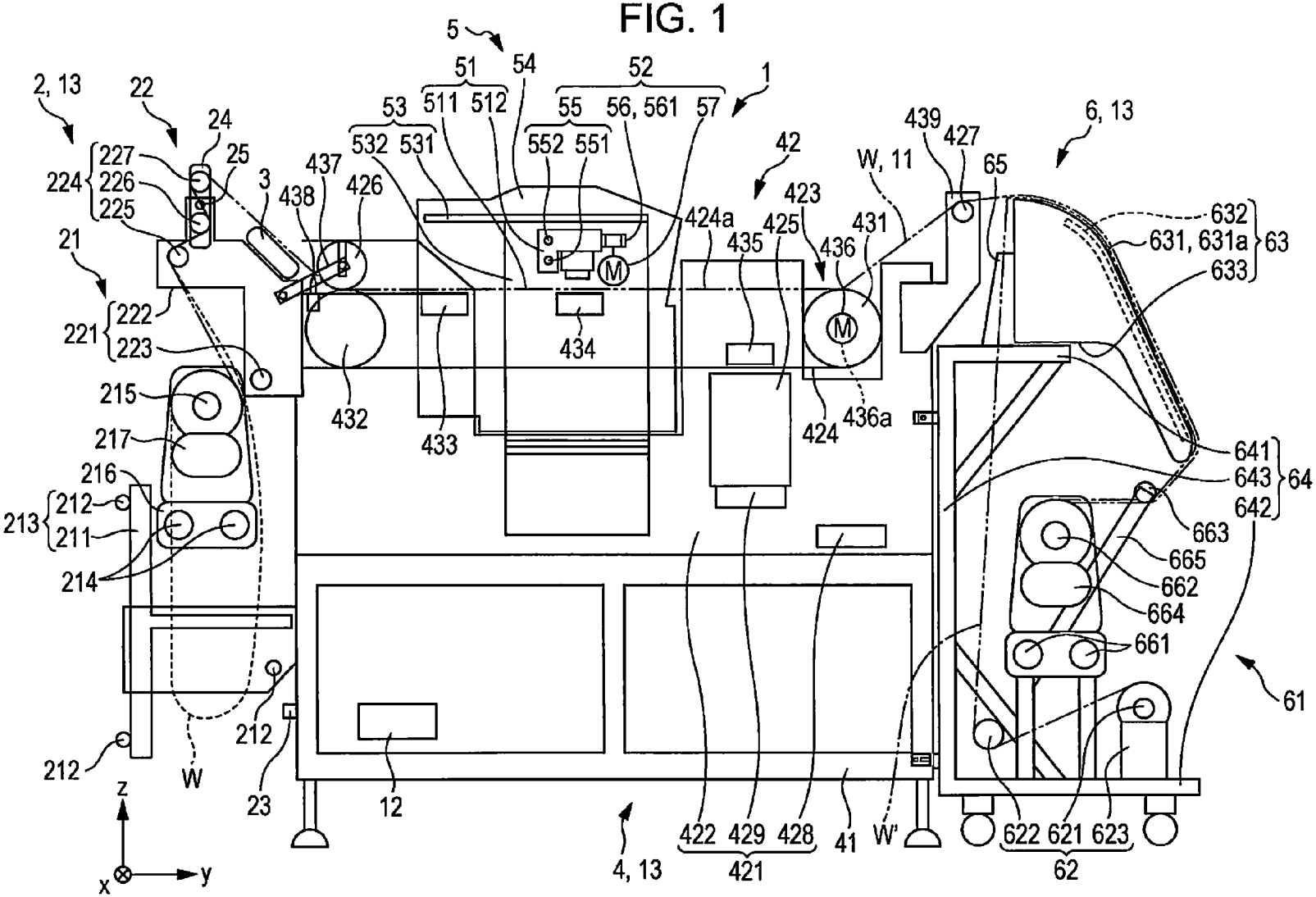
FIG. 1 is a side view schematically illustrating an exemplary embodiment of a printing apparatus according to the invention.
Figure 2:
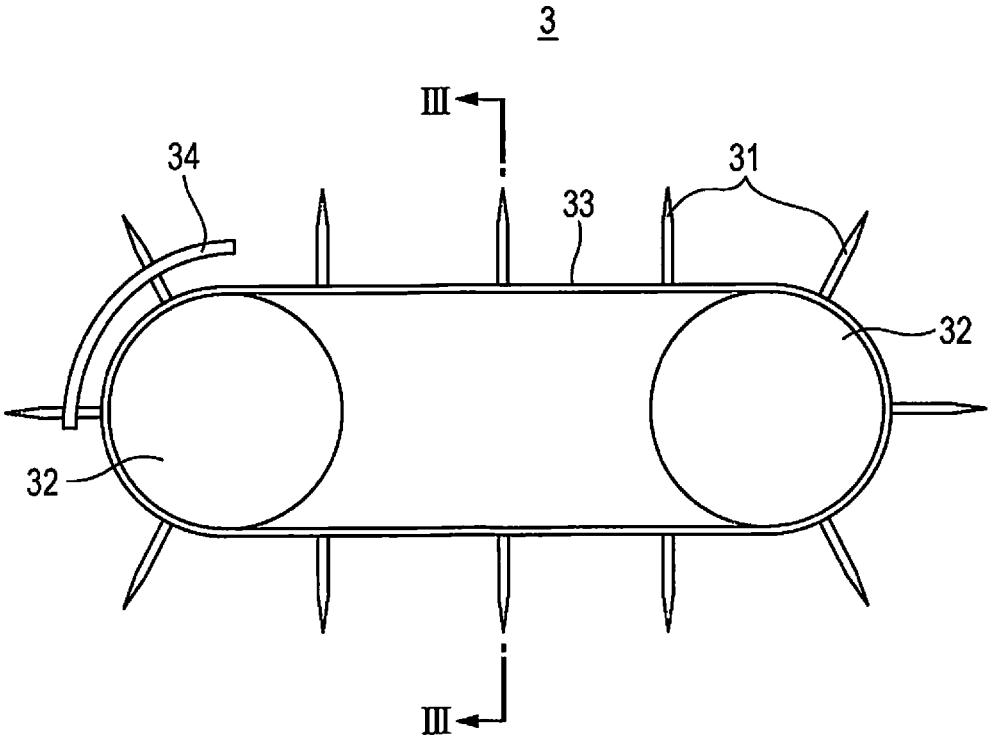
FIG. 2 is a side view schematically illustrating a cockle removing mechanism of the printing apparatus in FIG. 1.
Figure 3:
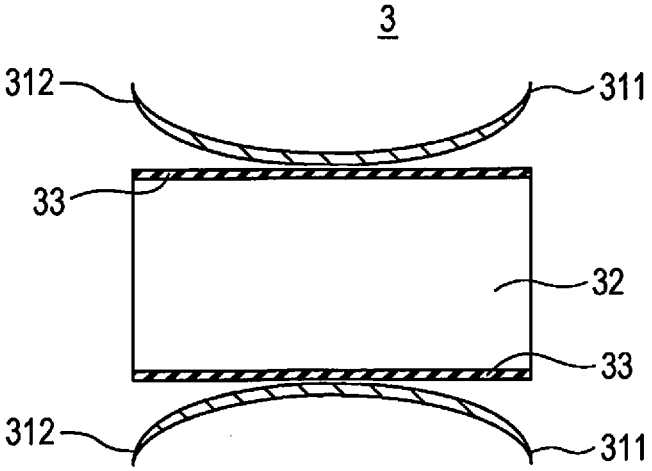
FIG. 3 is a cross-sectional view of the cockle removing mechanism in FIG. 2 when taken along line III-III.
Figure 4:
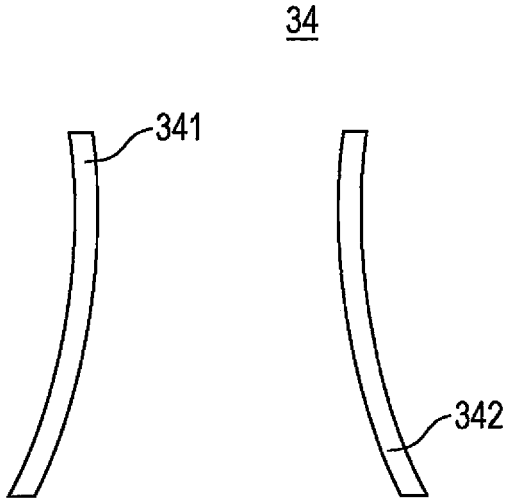
FIG. 4 is a plan view of a distance adjusting mechanism (cam mechanism) which is included in the cockle removing mechanism in FIG. 2.

FIG. 1 is a side view schematically illustrating an exemplary embodiment of a printing apparatus according to the invention. FIG. 2 is a side view schematically illustrating a cockle removing mechanism of the printing apparatus in FIG. 1. FIG. 3 is a cross-sectional view of the cockle removing mechanism in FIG. 2 when taken along line III-III. FIG. 4 is a plan view of a distance adjusting mechanism (cam mechanism) which is included in the cockle removing mechanism in FIG. 2. Hereinafter, for convenience of description, a depth direction from the paper surface in FIG. 1 is referred to as an "x-axis direction", a right-left direction is referred to as a "y-axis direction", and a vertical direction is referred to as a "z-axis direction".

A printing apparatus 1 illustrated in FIG. 1 prints (textile-prints) a pattern or the like on a fabric (original fabric) which is removed and supplied in a so-called reel-to-reel manner using dedicated dye ink by an ink jet method. In the printing apparatus 1, a direction (horizontal direction) in which a recording medium W which is a fabric is transported corresponds to the y-axis direction, a direction orthogonal to the y-axis direction corresponds to the x-axis direction, and the perpendicular direction corresponds to the z-axis direction.

The printing apparatus 1 includes an unwinding section 2 that unwinds and feeds the recording medium W wound in a roll shape, a cockle removing mechanism 3 that removes a cockle of the unwound recording medium W, an apparatus main body 4 that feeds the unwound recording medium W along a feeding path 11 so as to printing is performed, a printing mechanism section (recording unit) 5 that is disposed on the upper side of the apparatus main body 4 and performs printing on the recording medium W by the ink jet method in cooperation with the apparatus main body 4, a winding section 6 that winds an collects the recording medium W on which printing is performed by the printing mechanism section 5, downstream in the feeding direction from the apparatus main body 4, and a controller (control unit) 12 that controls operations of these sections. In the printing apparatus 1, a transport mechanism section (transport unit) 13 is configured to have the unwinding section 2, the cockle removing mechanism 3, the apparatus main body 4, and the winding section 6, and transports the elongated recording medium W in the longitudinal direction, that is, y-axis direction.

The apparatus main body 4 includes a main body base 41 that is configured of assembled steel materials, and a medium feeding mechanism 42 that is supported by the main body base 41 and intermittently feeds the recording medium W through belt transport in the y-axis direction.

The printing mechanism section 5 includes a carriage unit 51 that has an ink jet head 511 and a head moving mechanism 52 that causes the carriage unit 51 to reciprocate in the x-axis direction.

The unwinding section 2 includes an unwinding unit 21 that unwinds the recording medium W and a tensioning unit 22 that causes looseness of the unwound recording medium W to disappear.

The winding section 6 includes a winding unit 61 that winds the recording medium W, a slip sheet unit 62 that supplies a slip sheet W' to the winding unit 61, and a heater unit 63 that vaporizes a solvent (water) of the dye ink infiltrated into the recording medium W before the recording medium W is wound. These units are configured to be mounted on the winding section base 64.

In the recording medium W (fabric) unwound from the unwinding unit 21, the looseness disappears by the tensioning unit 22 through stretching and then, the recording medium is fed to the cockle removing mechanism 3.

A cockle on the recording medium W fed to the cockle removing mechanism 3 is removed and then, is fed to the medium feeding mechanism 42. The recording medium W fed to the medium feeding mechanism 42 is adhered to a surface and is transported on a belt. In this belt transport, the recording medium W is intermittently fed in the y-axis direction (sub-scanning), concurrently the carriage unit 51 reciprocates in the x-axis direction and then, ink discharge from the ink jet head 511 is performed (main scanning).

In this manner, after the printing is performed, a printing-finished portion (textile-printing finished portion) of the recording medium W is sent to the winding section 6 from the medium feeding mechanism 42. In the winding section 6, the slip sheet W' is continuously supplied from the slip sheet unit 62 to the recording medium W sent from the medium feeding mechanism 42 and the recording medium W and the slip sheet W' are superposed and are fed to the heater unit 63. In the heater unit 63, the recording medium W is heated along with the slip sheet W' and the solvent (water) of the dye ink is vaporized. In this manner, the textile-printing finished recording medium W after subjected to a dry treatment is wound around the winding unit 61 along with the slip sheet W'.

The unwinding unit 21 includes a pair of right and left (x-axis direction) T-shaped frames 211 fixed to the main body base 41 described above, an unwinding frame 213 that is formed of a plurality of rod-like frames 212 straddling across the pair of T-shaped frames 211, two unwinding-side rod bases 214 that are slidably supported by the pair of T-shaped frames 211 in the x-axis direction and extend in the x-axis direction, and a pair of unwinding-axis protrusions (feeding roll) 215 which are slidably supported by the two unwinding-side rod bases 214. A tip portion of each of the unwinding-axis protrusions 215 is formed to have a truncated cone shape, the tip portions of the pair of unwinding-axis protrusions 215 are fitted to unwinding cores of the roll-shaped recording medium W by widthwise closeness to each other corresponding to the width of the recording medium W and horizontally supports the recording medium W. In this support state, the recording medium W is sent toward the medium feeding mechanism 42 (transport belt 424) side.

The pair of unwinding-axis protrusions 215 are configured to integrally move in a right-left direction (width direction of the recording medium W) by a motor-driven width moving unit 216 via two unwinding-side rod bases 214.

In addition, a motor-driven rotating unit 217 is assembled on one of the pair of unwinding-axis protrusions 215 and the pair of unwinding-axis protrusions 215 are caused to rotate to perform unwinding by the rotating unit 217 such that the recording medium W is unwound. Further, a reflection type optical sensor 23 that detects presence or absence of the recording medium W unwound from the unwinding unit 21 is provided below the unwinding unit 21.

According to the present embodiment, a tension mode in which constant tension is applied to the recording medium W and the recording medium W is unwound and a looseness mode in which tension is as small as possible and unwinding is performed are provided and modes are switched according to a type of recording medium W. The tension mode and the looseness mode are configured to be switchable on an operation screen (not illustrated) provided in the printing mechanism section 5 using a graphical user interface (GUI) button.

The tension mode is performed for a normal fabric (recording medium W) having low elasticity as a target and, in this case, for example, the controller 12 configured of a personal computer controls the rotating unit 217 such that predetermined tension is applied to the recording medium W and the recording medium is unwound toward a first roller 225. To be more specific, the controller 12 controls torque of a motor of the rotating unit 217 and thereby, drives the rotating unit 217 during a feeding operation of the recording medium W by the medium feeding mechanism 42 such that the recording medium W is unwound, and drives the rotating unit 217 during a feeding stop of the recording medium W by the medium feeding mechanism 42 such that the recording medium W is slightly rewound. Accordingly, the recording medium W is fed in a state in which tension is applied to the recording medium W between the unwinding unit 21 and the tensioning unit 22.

The looseness mode is performed for a fabric (recording medium W) having high elasticity such as a stocking, in this case, the controller 12 controls the rotating unit 217 (in FIG. 1, the recording medium W on the loosed portion is illustrated in a dashed line) such that the unwound recording medium W is temporarily loose downward and is fed to the tensioning unit 22. That is, when an amount of looseness of the recording medium W becomes small in response to the feeding operation of the recording medium W by the medium feeding mechanism 42 and optical sensor 23 provided on the lower side of the unwinding unit 21 detects "absence" of the recording medium W, the controller 12 positively drives the rotating unit 217 and the rotating unit 217 rotate so as to unwind the recording medium W and thereby, when the amount of looseness in increased and the optical sensor 23 detects "presence" of the recording medium W, the controller 12 stops the driving of the rotating unit 217. The recording medium W is fed by the control of the amount of looseness, the recording medium W between the unwinding unit 21 and tensioning unit 22 are appropriately loosened.

The tensioning unit 22 includes a pair of right and left (x-axis direction) L-shaped frames 222 fixed to a side frame 422 of the medium feeding mechanism 42, a looseness removing frame 221 that is formed of a rod frame 223 straddling across the pair of L-shaped frames 222, and a roller group 224 rotatably supported by both sides of the pair of L-shaped frames 222. The roller group 224 includes a first roller 225, a second roller 226, and a third roller 227 which are disposed in the order from upstream side in the feeding direction so as to bend, at a plurality of places, the feeding path 11 of the recording medium W sent in from the unwinding unit 21, and is configured to have rollers of which a coefficient of friction is high.

The recording medium W unwound from the unwinding unit 21 makes a U-turn or the like at the first roller 225 and reaches the second roller 226 and the third roller 227. The second roller 226 and the third roller 227 are disposed to be close vertically and are rotatably supported by a pair of bearing units 24 of which both end portions are integrally formed. In addition, the bearing units 24 are rotatably supported by the L-shaped frames 222 and an angle adjusting unit 25 that adjusts vertical disposition angle of the second roller 226 and the third roller 227 are assembled to the bearing unit 24.

The recording medium W that passes the second roller 226 and the third roller 227 has a changed S-shaped path; however, the "S"-shaped curve is changed and adjusted depending on types of recording media and the moderate tension can be applied to each of the recording medium W. Accordingly, the partial looseness or cockle of the recording medium W is removed and is fed to the medium feeding mechanism 42. It is preferable that the first roller 225, the second roller 226, and the third roller 227 have a convex portion such that a component of a force acts toward the outer side from the center.

As illustrated in FIGS. 2 and 3, the cockle removing mechanism 3 includes a pair of rollers 32, an endless belt 33 that crosses over the pair of rollers 32, a plurality of arcuate members 31 fixed to the belt 33, and a distance adjusting unit 34 that adjusts the distance of both ends of the arcuate member 31.

The endless belt 33 is configured to rotate by following the transport of the recording medium W and is configured so as to rotate in the clockwise direction in FIG. 2.

The arcuate member 31 has an arcuate shape and includes a first holding unit 311 and a second holding unit 312 on both ends thereof.

The first holding unit 311 and the second holding unit 312 have a needle shape. A needle-like tip of the first holding unit 311 punctures the vicinity of one end of the recording medium W and holds the one end of the recording medium W. In addition, a needle-like tip of the second holding unit 312 punctures the vicinity of the other end of the recording medium W and holds the other end of the recording medium W.

The distance adjusting unit 34 is provided so as to include positions where the recording medium W comes into contact with the arcuate member 31.

The distance adjusting unit 34 is configured to have a rail 341 and a rail 342.

An space between the rail 341 and the rail 342 are configured to become greater on the side of the lower end (upstream in the movement direction of the arcuate members 31) in FIG. 4, and to become narrower on the side of the upper end (downstream in the movement direction of the arcuate members 31) in FIG. 4.

The space between the rail 341 and the rail 342 on the upstream side in the movement direction of the arcuate members 31 is configured to be slightly greater than the space between the first holding unit 311 and the second holding unit 312 of the arcuate member 31 in a state in which no load is applied. The space between the rail 341 and the rail 342 on the downstream side in the movement direction of the arcuate member 31 is configured to be slightly narrower than the space between the first holding unit 311 and the second holding unit 312 of the arcuate member 31 in a state in which no load is applied.

As employing such a configuration, when the arcuate member 31 passes between the rail 341 and the rail 342, the space between the first holding unit 311 and the second holding unit 312 becomes narrower by the distance adjusting unit 34. In a state in which the first holding unit 311 and the second holding unit 312 becomes closer, the first holding unit 311 and the second holding unit 312 come into contact with the recording medium W and hold the vicinities of the end of the recording medium W, respectively. In this state, when the recording medium W is farther transported and passes the arcuate member 31 and the distance adjusting unit, the first holding unit 311 and the second holding unit 312 move in a separating direction from each other because the arcuate member 31 enters into a state in which no load is applied. Accordingly, the stress is applied to the outer sides of the recording medium W in the width direction (lateral direction) and the cockle of the recording medium W is removed.

Depending on the type of recording medium W, a material of the arcuate member 31 is changed and the space between the rail 341 and the rail 342 in the vicinity of an exit of the arcuate member 31 is changed. Then, it is possible to change the stress applied to the recording medium W.

The medium feeding mechanism 42 includes a main body frame 421 that has a pair of right and left (x-axis direction) side frames 422 mounted and fixed on the main body base 41, a belt transport unit 423 that is supported by the pair of side frame 422 and has an endless transport belt (endless belt) 424, and a belt cleaning unit 425 disposed on the lower side from the belt transport unit 423. In addition, the medium feeding mechanism 42 includes a press roller 426 facing the belt transport unit 423 on the upstream side from the upper side and a separation roller 427 that is disposed obliquely upward with respect to the belt transport unit 423 on the upstream side.

The main body frame 421 has the pair of side frames 422 which are configured of thick plate materials and a pair of front and rear (y-axis direction) connection frames 428 that connect the side frame 422 and the main body frame 421 is mounted and fixed to the main body base 41 at a portion of the pair of side frames 422. In addition, the main body frame 421 has a support frame 429 which is positioned between the pair of connection frames 428, is coupled with the pair of side frame 422, and supports the belt cleaning unit 425 described above. In each of the side frames 422, a notch portion to which the belt transport unit 423 is attached or a notch portion to which the printing mechanism section 5 is attached are appropriately provided, and in addition, an opening is formed, through which the belt cleaning unit 425 is checked.

The belt transport unit 423 includes a drive pulley 431 positioned upstream in the transport direction, a driven pulley 432 that is positioned upstream in the feeding direction, and an endless transport belt 424 which is cross-linked between the drive pulley 431 and the driven pulley 432. In addition, the belt transport unit 423 includes a first guide plate 433 that is positioned around the driven pulley 432 and guides travelling of the transport belt 424, a second guide plate 434 that is positioned immediately below the printing mechanism section 5 and guides the travelling the transport belt 424, and a third guide plate 435 that is positioned immediately below the support frame 429, and guides the travelling of the transport belt 424 rounded to the back side.

The first guide plate 433 and the second guide plate 434 cross-links between the pair of side frames 422 in a state of being disposed such that the surfaces are flush (the same horizontal surface) to each other, and thus, function as a part of the main body frame 421. In addition, the first guide plate 433 guides the (upper) transport belt 424 so as to travel horizontally immediately after the transport belt 424 is separated from the driven pulley 432 and the second guide plate 434 guides the transport belt 424 that is positioned in a printing region such that looseness does not occur on the top side. Thus, the transport belt 424 positioned immediately above the second guide plate 434 functions as a platen. Further, the third guide plate 435 guides the transport belt 424 that receives an upthrust force by the belt cleaning unit 425 so as to be pressed down. The transport belt 424 immediately after (on the lower side) being separated from the drive pulley 431 travels horizontally. That is, the transport belt 424 travels horizontally at a position where cleaning is performed on the belt by the belt cleaning unit 425.

The drive pulley 431 and the driven pulley 432 are rotatably supported by the pair of side frames 422 via a dedicated bearing and a transport motor (motor) 436 that causes the transport belt 424 to intermittently travel is connected to one end of the drive pulley 431 in the axis.

An encoder 436*a* is installed in the transport motor 436. A rotating amount detected by the encoder 436*a* is adjusted and thereby, it is possible to reliably send the transport belt 424 intermittently. In addition, it is possible to reliably detect that the recording medium W is being transported, based on the detected rotating amount, that is, based on whether or not the transport motor 436 rotates.

The transport belt 424 is configured of a special wide width belt to have an outer circumferential surface (fixing unit) 424*a*, that is, a surface on the side facing the recording medium W is adhesive (adhesive treatment). The outer circumferential surface 424*a* corresponds to the fixing unit that holds an intermediate portion of the recording medium W in the longitudinal direction. The recording medium W is held by the adhesion of the outer circumferential surface 424*a* (fixing unit) and is transported by the transport belt 424 which drives in this state. Accordingly, the recording medium W is intermittently transported immediately below the printing mechanism section 5 without an occurrence of curling or the like and recording is performed by ink discharged from the printing mechanism section 5.

The press roller 426 that presses the recording medium W sent from the cockle removing mechanism 3 to adhere to the transport belt 424 is disposed on the upper side of the driven pulley 432. The press roller 426 is rotatably supported by tips of a pair of support arms 437 rotatably supported by the side frame 422. In addition, the press roller 426 has a predetermined elasticity and a self-weight and presses the recording medium W against the transport belt 424 by the self-weight at a position immediately above the driven pulley 432. That is, the press roller 426 and the driven pulley 432 nip the transport belt 424 and function as nip rollers, and cause the recording medium W to continuously adhere to the travelling transport belt 424. An air cylinder 438 that rotates the support arms 437 is connected to an intermediate position of each of the support arms 437. A pair of the air cylinders 438 are synchronously driven and thereby, the press roller 426 is pulled apart from the transport belt 424.

A separation roller 427 that peels the recording medium W from the transport belt 424 after printing and sends the recording medium to the winding section 6 is disposed obliquely upward from the drive pulley 431. The separation roller 427 is rotatably supported by a pair of sub frames 439 extending from the side frame 422. In this case, the separation roller 427 relatively peels the recording medium W from the transport belt 424 that circles the drive pulley 431 and rounds to the back side but, in the actual operation, a peeling force from the transport belt 424 varies depending on types of recording media W. Therefore, depending on the types, the peeling is started at a position where the transport belt 424 starts circling and the peeling is performed at a position where the circling is performed to some extent. Here, when the peeling point is rounded to the back side, there is a concern that the recording medium W is caught in the transport belt 424.

According to the present embodiment, an angle of the recording medium W sent from the transport belt 424 and to the separation roller 427 is position-detected, the winding unit 61 is driven to perform winding based on the detection result of the position detection, and the point of peeling is prevented from rounding to the back side of the transport belt 424.

Since yarn waste or dust is attached on the transport belt 424 having adhesiveness, cleaning of the transport belt 424 is regularly performed by the belt cleaning unit 425. The belt cleaning unit 425 is supported by the support frame 429 on the lower side of the transport belt 424 and extends in the x-axis direction so as to cross the transport belt 424. Eventually, cleaning solution remaining on the transport belt 424 is wiped with a waste cloth.

The printing mechanism section 5 includes a printer frame 53 that extends in the x-axis direction so as to straddle the feeding path 11 (belt transport unit 423), a head moving mechanism 52 that is supported by the printer frame 53, carriage unit 51 that is mounted in the head moving mechanism 52 and reciprocates in the x-axis direction, and a printer cover 54 that covers all the parts. Although not illustrated particularly, the carriage unit or the cleaning unit that maintains the ink jet head 511 are mounted in the printing mechanism section 5. In the printing mechanism section 5, since various recording medium W has a thickness thereof and a width, a so-called paper gap (work gap) is adjusted by moving the entire printing mechanism section 5 vertically with respect to the apparatus main body 4 (medium feeding mechanism 42).

The printer frame 53 includes a beam-like frame 531 formed of a metal plate which extends in the x-axis direction and a pair of standing frames 532 formed of a metal plate which support the beam-like frame 531 by both end portions thereof. The side frame 422 described above is supported by a portion of the pair of standing frames 532. The printer cover 54 is attached to the printer frame 53.

The carriage unit 51 includes the ink jet head 511 that has a plurality of colors of nozzle rows for a color printer and a carriage 512 that holds the ink jet head 511 so that a nozzle surface faces downwards. The various colors of dye ink supplied to the nozzle rows are supplied from an ink tank of an off-carriage.

The head moving mechanism 52 includes a carriage guide 55 that holds the carriage unit 51 by one side and supports the carriage unit 51 so as to be slidable in the x-axis direction, a belt conveying mechanism 56 that causes the carriage guide 55 to reciprocate, and a carriage motor 57 that drives the belt conveying mechanism 56. The carriage guide 55 is formed of a lower main guide 551 and an upper sub guide 552. The lower main guide 551 and the upper sub guide 552 are supported by the pair of standing frames 532 at both ends thereof. The belt conveying mechanism 56 includes a timing belt 561 and a part of the timing belt 561 is fixed to the carriage unit 51 (carriage 512).

When the timing belt 561 is caused to perform forward or reverse travelling by the carriage motor 57, the carriage unit 51 is guided to the carriage guide 55 and reciprocates in the x-axis direction. The movement position of the carriage guide 55 is detected by a linear encoder and various colors of dye inks are selectively discharged from the ink jet head 511 based on the detection result and print data. Accordingly, the printing (textile-printing) is performed on the recording medium W.

The winding section 6 includes the winding section base 64 detachably connected to the main body base 41 in the y-axis direction, the heater unit 63 supported by the upper portion of the winding section base 64, and the winding unit 61 and the slip sheet unit 62 which are supported by the lower portion of the winding section base 64. The textile-printed recording medium W may be wound by the following two methods; one method in which the thick recording medium W in which the ink does not permeate to the back surface is wound as is and the other method in which a thin recording medium W in which the ink is likely to permeate to the back surface is wound with the slip sheet W' which overlaps the recording medium. The winding section 6 according to the present embodiment is designed to be applied to both methods. Hereinafter, the description of employing the latter is provided.

The winding section base 64 includes a horizontal upper frame portion 641, a horizontal lower frame portion 642, and a perpendicular frame portion 643 to which the horizontal upper frame portion 641 and the horizontal lower frame portion 642 are connected, respectively, and is configured to have extruded aluminum members assembled horizontally and vertically. A portion of the perpendicular frame portion 643 is detachably connected to the main body base 41.

The heater unit 63 includes a radiating plate 631 that has an arc-shaped radiating surface 631*a*, a heater 632 that is internally attached to the radiating plate 631, and a pair of right and left support plates 633 that are provided on the inner right and left ends of the radiating plate 631 and have an elephant trunk shape. In addition, the heater unit 63 (support plates 633) is attached to the horizontal upper frame portion 641 by the right and left fixing member 65 provided in the horizontal upper frame portion 641 in a state in which the upper half thereof is mounted on the horizontal upper frame portion 641. The upper end of the radiating plate 631 approaches the separation roller 427 and is disposed at a slightly lower position than the separation roller 427. In addition, the upper end of the radiating plate 631 is formed to be bent in a downward arc shape such that the slip sheet W' guided in from the lower side changes the path.

The recording medium W which passed the separation roller 427 is superposed with the slip sheet W' which is sent from the lower side to the upper end of the radiating plate 631 and is guided to the arc-shaped outer surface (radiating surface 631*a*) of the radiating plate 631 and then, is sent to the lower side. The recording medium W and the slip sheet W' which come into sliding contact with the radiating surface 631*a* and are sent in the vertical direction are continuously heat by the heater 632. Through the heating, the solvent (water) of the dye ink infiltrated into the recording medium W evaporates and dye is fixed on the fabric.

The slip sheet unit 62 includes a slip sheet roller 621 that unwinds the roll-shaped slip sheet W' and a guide bar 622 that changes the path of the unwound slip sheet W' toward the upper end of the radiating plate 631. The guide bar 622 is fixed to a diagonal member that connects the horizontal lower frame portion 642 to the perpendicular frame portion 643. In addition, a slip sheet roller 621 is supported on a front section of the horizontal lower frame portion 642 via the pair of bearing units 623 which assembles a control mechanism. The slip sheet W' is unwound by the pair of bearing units 623 without looseness.

Similar to the unwinding unit 21, the winding unit 61 includes two winding side rod bases 661 that is supported by an intermediate portion in the front-rear direction of the horizontal lower frame portion 642 and extends in the x-axis direction and a pair of winding-axis protrusions 662 slidably supported by the two winding side rod bases 661. In addition, the winding unit 61 includes a tension roller 663 that is positioned on the feeding path 11 between the lower end of the radiating plate 631 and the pair of winding-axis protrusions 662 and applies tension to the recording medium W and the slip sheet W'.

The tip of the winding-axis protrusion 662 is formed to have a truncated cone shape, the tip portions of the pair of winding-axis protrusions 662 are fitted to winding cores around which the recording medium W is wound by widthwise closeness to each other corresponding to the width of the recording medium W and horizontally supports the recording medium W. A motor-driven rotating unit 664 is assembled on one of the pair of winding-axis protrusions 662 and the pair of winding-axis protrusions 662 are caused to rotate and the recording medium W and the slip sheet W' are wound concurrently. The rotating unit 664 is controlled in the vicinity of the separation roller 427 as described above based on angle detection of the recording medium W which is sent to the separation roller 427.

The tension roller 663 is rotatably supported by tips of a pair of rotation arms 665 rotatably supported by a rear portion of the horizontal lower frame portion 642. The tension roller 663 comes into rolling contact with t with the slip sheet W' side of the recording medium W which is wound around the winding core and the slip sheet W' and biases the recording medium W and the slip sheet W' by the self-weight thereof downward by rotating. Accordingly, appropriate tension is applied to the recording medium W and the slip sheet W' and the recording medium W and the slip sheet W' are wound around the winding cores so as to be tightly wound.

The controller 12 is electrically connected to the transport mechanism section 13, the printing mechanism section 5, and the like, and has a function of controlling the operations of the sections.

As above, the embodiments of the printing apparatus and the cockle removing method of the invention illustrated in the drawings are described; however, the invention is not limited thereto and it is possible to replace components which configures the printing apparatus with components in an arbitrary configuration that can exhibit the same function. In addition, an arbitrary component may be added.

Figure 5:
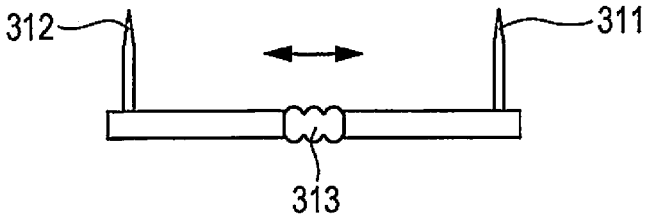
FIG. 5 is a view schematically illustrating another embodiment of a cockle removing mechanism.

In addition, according to the embodiment described above, the cockle removing mechanism is described to include the arcuate member; however, the configuration is not limited thereto and the cockle removing mechanism may have a configuration in which, for example, as illustrated in FIG. 5, a member that includes the first holding unit 311 and a member that includes the second holding unit 312 are connected to each other by an elastic member 313 that can be elastic in an arrow direction in the drawing.

In addition, according to the embodiments described above, the first holding unit and the second holding unit are described to have a needle shape; however, the configuration is not limited thereto and the first holding unit and the second holding unit may have a shape by which the end of the recording medium in the lateral direction is pinched.

The entire disclosure of Japanese Patent Application No. 2014-065413, filed Mar. 27, 2014 is expressly incorporated by reference herein.

What is claimed is:

1. A printing apparatus comprising:

a transport unit that has a fixing unit which holds a part of an elongated recording medium and that transports the recording medium;

a recording unit that discharges ink onto the recording medium; and a cockle removing mechanism that removes a cockle on the recording medium when the recording medium is sent toward the fixing unit side, wherein the cockle removing mechanism has a first holding unit that holds one end portion of the recording medium in a lateral direction, a second holding unit that holds the other end portion of the recording medium in the lateral direction, and a moving unit configured to move the first holding unit and the second holding unit in conjunction with transportation of the recording medium by the transport unit, wherein the first holding unit and the second holding unit are configured to apply stress to the recording medium in a separating direction from each other as a distance between the first holding unit and the second holding unit increases while the first holding unit and the second holding unit are moved in conjunction with the transportation of the recording medium and while the first holding unit holds the one end portion of the recording medium in the lateral direction and the second holding unit holds the other end portion, wherein the moving unit includes a pair of rollers and an endless belt that crosses over the rollers, and the first holding unit and the second holding unit are disposed on the endless belt.

2. The printing apparatus according to claim 1, wherein the first holding unit and the second holding unit have a needle shape.

3. The printing apparatus according to claim 1, wherein the first holding unit and the second holding unit have a nipping mechanism, and wherein the first holding unit is configured to nip one end portion of the recording medium in the lateral direction and the second holding unit is configured to nip the other end portion of the recording medium in the lateral direction.

4. The printing apparatus according to claim 1, wherein the cockle removing mechanism includes an arcuate member, and wherein the first holding unit and the second holding unit are provided on both end sides of the arcuate member, respectively.

5. The printing apparatus according to claim 1, further comprising:

a distance adjusting unit that adjusts the distance between the first holding unit and the second holding unit.

6. The printing apparatus according to claim 1, wherein the stress applied to the recording medium is changed depending on a type of recording medium.

7. The printing apparatus according to claim 1, wherein the fixing unit has an endless belt which has an adhesive surface on a side facing the recording medium.

8. A cockle removing method of removing a cockle on an elongated recording medium on which ink is applied during transporting of the recording medium, the method comprising:

moving a first holding unit and a second holding unit in conjunction with transportation of the recording medium with a pair of rollers and an endless belt which crosses over the rollers and on which the first holding unit and the second holding unit are disposed; and applying stress to the outer sides of the recording medium in a lateral direction, with respect to the recording medium as a distance between the first holding unit and the second holding unit increases while the first holding unit and the second holding unit are moved in conjunction with the transportation of the recording medium and while the first holding unit holds one end portion of the recording medium in the lateral direction and the second holding unit holds the other end portion.

* * * * *